US008661803B2

(12) United States Patent
Sponsky et al.

(10) Patent No.: US 8,661,803 B2
(45) Date of Patent: Mar. 4, 2014

(54) EXHAUST DIFFUSER FOR A TRUCK

(75) Inventors: John Sponsky, Chambersburg, PA (US); Edward M Smith, III, McConnellsburg, PA (US)

(73) Assignee: Mack Trucks, Inc., Greensboro, NC (US)

( * ) Notice: Subject to any disclaimer, the term of this patent is extended or adjusted under 35 U.S.C. 154(b) by 636 days.

(21) Appl. No.: 12/743,439

(22) PCT Filed: Dec. 18, 2007

(86) PCT No.: PCT/US2007/026019

§ 371 (c)(1), (2), (4) Date: May 18, 2010

(87) PCT Pub. No.: WO2009/078845

PCT Pub. Date: Jun. 25, 2009

(65) Prior Publication Data

US 2010/0242460 A1 Sep. 30, 2010

(51) Int. Cl.
*F01N 1/00* (2006.01)

(52) U.S. Cl.
USPC ..... 60/324; 60/317; 60/319; 60/320; 454/37; 454/38

(58) Field of Classification Search
USPC ..... 60/274, 285–287, 295–301, 317, 324; 454/35–41
See application file for complete search history.

(56) References Cited

U.S. PATENT DOCUMENTS 238,185 A * 2/1881 Van Norden ..... 454/38
811,764 A * 2/1906 Colegrove ..... 454/37
1,217,615 A 2/1917 McDowell
1,813,189 A 7/1931 Moore
1,996,098 A * 4/1935 Chase ..... 431/146
D135,040 S * 2/1943 Rowland ..... D23/376
2,547,448 A 2/1946 Demuth
3,209,670 A 10/1965 Twickler
4,069,668 A * 1/1978 Oldberg ..... 60/317
4,106,290 A * 8/1978 Johnson ..... 60/324
(Continued)

FOREIGN PATENT DOCUMENTS

BE 509107 * 2/1952 ..... F23L 17/02
BE 509107 A 2/1952
JP 2002174108 A 6/2002
JP 2003313901 A 11/2003

OTHER PUBLICATIONS

Supplementary European search report for corresponding EP 07867866, (Jan. 28, 2011).

*Primary Examiner* — Thomas Denion
*Assistant Examiner* — Jesse Bogue
(74) *Attorney, Agent, or Firm* — Martin Farrell; Michael Pruden

(57) ABSTRACT

An exhaust diluting and diffusing apparatus includes a first pipe forming a vertically directed outlet for an exhaust conduit and a second diffuser pipe mounted to receive an exhaust gas flow from the outlet of the first pipe, the second pipe having a diameter greater than the diameter of the first pipe to define an ambient air inlet gap surrounding the outlet of the first pipe, and being sufficiently wide to allow the exhaust gas to expand and diffuse in the second pipe. The device further includes a dispersing outlet mounted at an end of the second pipe and configured to direct exhaust gas radially outward, an area defined by the diffuser outlet being greater than an area of the outlet of the first pipe.

8 Claims, 3 Drawing Sheets

(56) References Cited

U.S. PATENT DOCUMENTS 4,159,078 A * 6/1979 Diermayer et al. ..... 236/1 G
4,198,817 A * 4/1980 Fujita et al. ..... 60/319
4,487,289 A * 12/1984 Kicinski et al. ..... 181/252
5,170,020 A * 12/1992 Kruger et al. ..... 181/211
7,207,172 B2 * 4/2007 Willix et al. ..... 60/317
2007/0163247 A1 7/2007 Ryan

* cited by examiner

EXHAUST DIFFUSER FOR A TRUCK

The invention relates to devices mounted on truck exhaust systems to dilute and diffuse the exhaust gas for release to the environment.

BACKGROUND

Exhaust treatment devices in trucks require maintenance procedures that can create situations where exhaust temperatures are much higher than during normal use of the vehicle. For example, diesel particulate filters, which trap soot and other particulate matter in the exhaust stream, require a regeneration process to burn off the collected particulate matter. The process requires that the temperature of the exhaust entering the diesel particulate filter be in excess of 600° C. Normal operating exhaust temperature is about 425° C. for a diesel engine in a truck.

Exhausting the higher temperature stream to the environment can pose difficulties, particularly for trucks operating in close environments. A truck typically has an exhaust stack pipe rising from the chassis adjacent to the truck cab. High temperature exhaust can produce a hot spot on the truck cab or trailer, or direct hot gases to a building (such as at a loading dock) or an overhanging tree.

What is needed is a device to reduce the exhaust temperature of an internal combustion engine.

SUMMARY OF THE INVENTION

The invention includes an exhaust diffuser, a relatively short, relatively wide stack mounted on an exhaust pipe. The diffuser allows entering exhaust gas and its heat energy to diffuse over the larger volume. The stack induces a buoyancy induced flow that is created by the difference in density between the low density, high energy exhaust flow, and the higher density of the surrounding ambient air. This buoyancy induced flow, or "stack effect", induces a flow of ambient air into the exhaust diffuser, which mixes with hot exhaust gas and cools it.

The invention further includes an outlet formed as axisymetric louvers mounted at the top of the stack. The louvers include a central diverter to balance the flow distribution radially. The outlet louvers define a greater area than the outlet of the exhaust pipe so also to act as a diffuser. This decelerates the exhaust gas flow as it flows from the outlet which allows it to readily mix with additional ambient air, which further cools the exhaust gas. The combination of the "stack effect" and "diffuser mixing effect" cool the exhaust gas by an amount that neither would be able to achieve on their own.

The loss in stack effect due to reduced height is countered by the increasing the diameter so as to better utilize the flow energy.

An exhaust diluting and diffusing apparatus in accordance with the invention includes a first pipe forming a vertically directed outlet for an exhaust conduit and a second diffuser pipe mounted to receive an exhaust gas flow from the outlet of the first pipe, the second pipe having a diameter greater than the diameter of the first pipe to define an ambient air inlet gap surrounding the outlet of the first pipe, and being sufficiently wide to allow the exhaust gas to expand and diffuse in the second pipe. The device further includes a dispersing outlet mounted at an end of the second pipe and configured to direct exhaust gas radially outward, an area defined by the diffuser outlet being greater than an area of the outlet of the first pipe.

BRIEF DESCRIPTION OF THE DRAWINGS

The invention will be better understood by reference to the following detailed description read in conjunction with the appended drawings, in which.

DETAILED DESCRIPTION

The invention relates to devices that are mounted on a truck exhaust system at the point where exhaust gas is released to the surrounding air. In particular, the invention is an apparatus mounted on an exhaust conduit downstream of a diesel particulate filter to diffuse the hot gases exiting the diesel particulate filter over a wide area. According to another aspect of the invention, structure is provided to dilute exhaust gases with ambient air and diffuse the diluted exhaust gas over a wider area than a typical exhaust stack pipe to prevent hot spots and dissipate heat more quickly.

Figure 1:
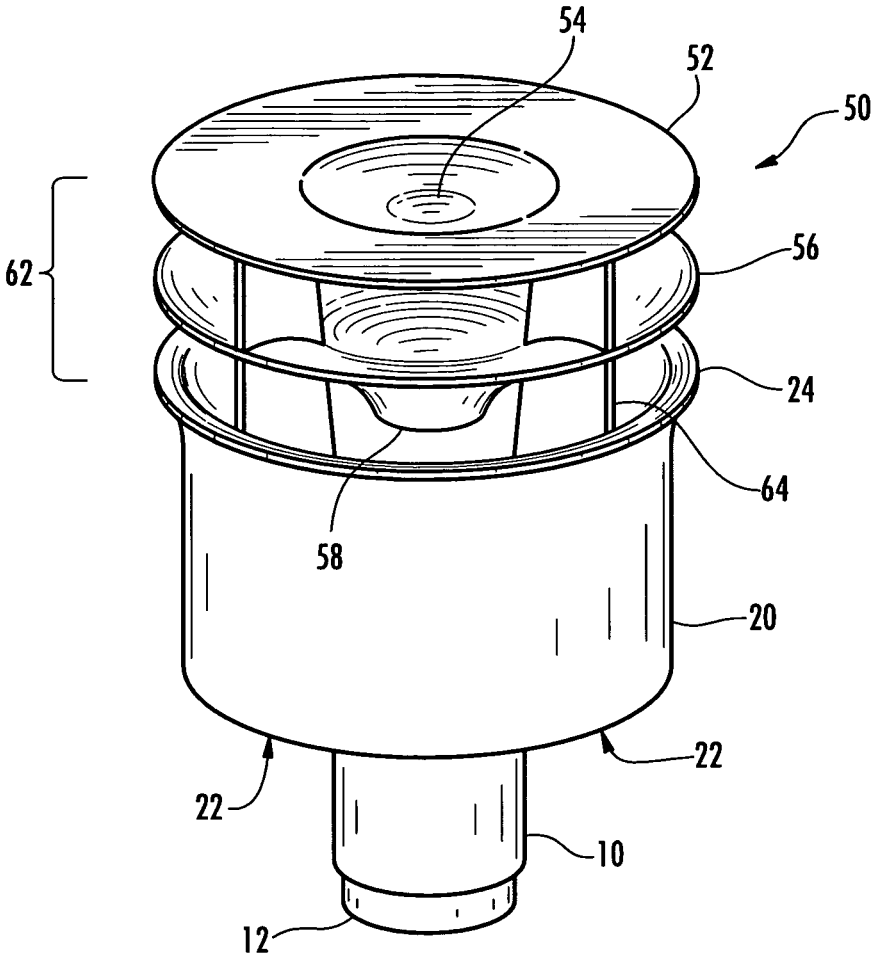
FIG. 1 illustrates an embodiment of an exhaust stack dilution and diffusion element in perspective view.

FIG. 1 shows a perspective view of a diluter/diffuser device in accordance with an embodiment of the invention. The device comprises a first pipe 10 that is mountable on an exhaust stack (not illustrated) of a heavy truck. The first pipe 10 may include a reduced diameter fitting 12 that can be inserted into the truck exhaust stack to facilitate mounting of the device. Heavy trucks use a standard 5 inch diameter exhaust pipe, and the invention is readily adapted to fit this standard pipe, but can be adapted to other size exhaust pipes as will be understood.

The first pipe 10 has an exhaust or outlet (not shown in FIG. 1; see, outlet 14 in FIG. 3) that is disposed inside a second pipe 20 or diffuser. The second pipe 20 has a diameter greater than the diameter of the first pipe 10 to define an inlet gap 22 surrounding the first pipe. The inlet gap 22 allows ambient air to enter the second pipe 20 to mix with the exhaust gas entering the second pipe from the first pipe 10. Exhaust gas and ambient air mix in the second pipe 20 as the gases flow through.

The diffuser 20 is made sufficiently wider than the exhaust outlet of the first pipe 10 so that the entering exhaust gas expands and decelerates in the interior volume of the diffuser.

To cool the exhaust gas, the device in accordance with the invention relies on the buoyancy of the exhaust gas flowing through the second pipe 20 to induce a flow of ambient air into the second pipe. The buoyancy or stack effect is created by the hotter exhaust gases expanding in the second pipe 20 and developing a pressure gradient inducing ambient air into the second pipe. Accordingly, two features of the invention, which will be described further below, include the second pipe 20 being sufficiently wider than the first pipe to allow the exhaust gas exiting the first pipe to expand, and the first pipe 10 and at least a portion of the second pipe 20 being vertically oriented to allow the hot exhaust gas to entrain ambient air via buoyancy effects.

The device of the invention further includes a disperser 50 mounted at the end of the second pipe 20, and configured to direct the mixed exhaust gas and ambient air radially outward. The disperser 50 includes an end cap or end plate 52 having a diverter 54 extending into the gas flow to direct the upward flowing gases outward. In the illustrated embodiment, the diverter 54 is a conically shaped protrusion extending from a lower surface of the end plate 52.

An upper edge 24 of the second pipe 20 is flared outward and upward in a frusto-conical profile also to guide flowing gases in the radially outward exiting direction of the diffuser 20.

Figure 2:
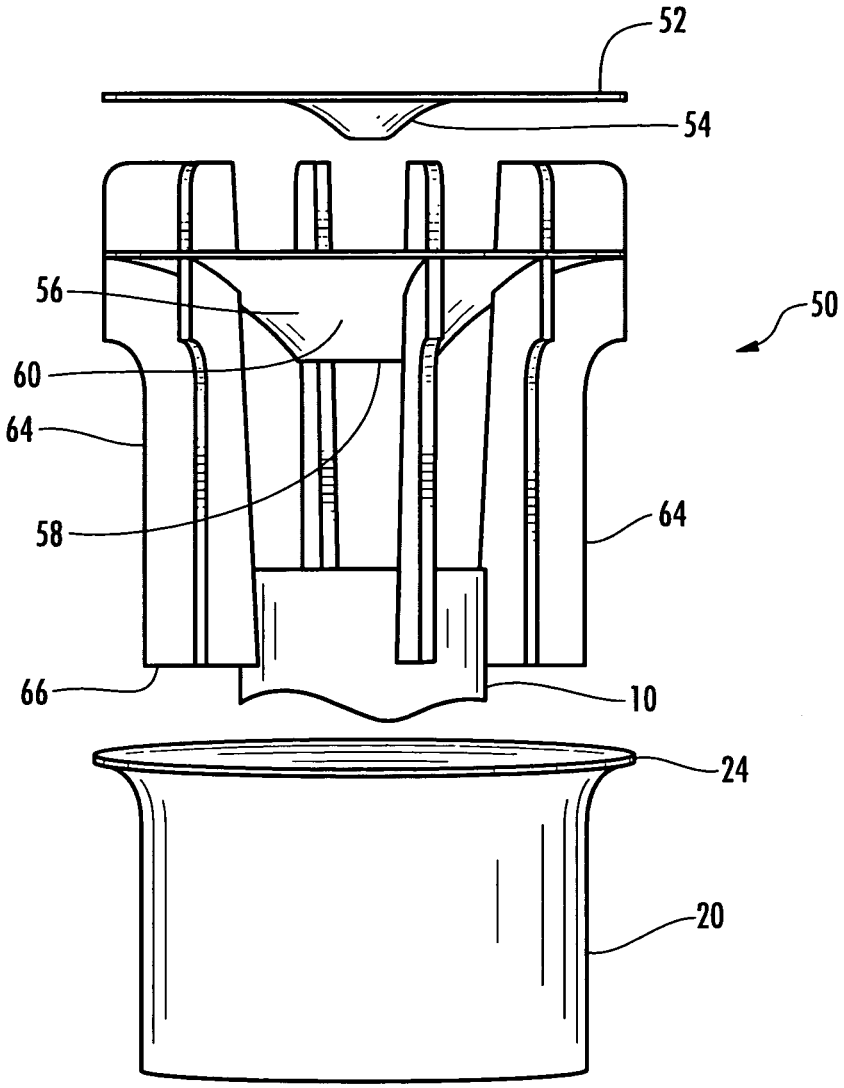
FIG. 2 is an exploded view of the exhaust stack dilution and diffusion element of FIG. 1; and, FIG. 3 is a schematic view of the exhaust stack dilution and diffusion element of the invention illustrating certain size relationships.

Turning now to FIG. 2, the invention is shown in exploded view to better show some of the details. In FIG. 2, only an upper end portion of the first pipe 10 is shown, the rest being omitted for clarity of the illustration. The disperser 50 is shown removed from the second pipe 20. The end plate 52 is shown separated from the disperser 50, also for clarity.

As mentioned, the disperser 50 directs the flow of mixed exhaust gas and ambient air radially outward. The end plate 52 forms a barrier at the axial end of the diffuser and the diverter 54 is provided to help turn the flow from the axial direction to the radial direction. An annular deflector plate 56, which provides a second diverter, is positioned to divide the flow and direct a portion of the flow radially outward. In combination, the end plate 52 and second diverter 56 spread or diffuse the flow over a greater outlet area than either would alone. The second diverter 56 is formed as a plate having a central hole 58 to allow a portion of the exhaust and air flow to flow through toward the end plate 52. A lower surface 60 protrudes downward into the flow and is curved in profile to form a guide turning the flow outward. In the illustrated embodiment, the second diverter 56 has a frusto-conical cross section.

The second diverter 56 is positioned between the upper edge 24 of the second pipe 20 and the end plate 52 of the disperser 50. Referring again to FIG. 1, an outlet 62 of the disperser 50 is thus defined as the area between the upper edge 24 of the second pipe 20 and the end plate 52 of the diffuser.

The disperser 50 further comprises a plurality of fins 64 which are vertically and radially oriented with respect to the axial direction of the device, and regularly spaced around the diffuser. The fins 64 extend radially inward from the outlet 62 of the disperser 50. The fins 64 help disperse and diffuse the exhaust flow over the outlet 62 area of the disperser 50. As illustrated, the fins 64 are mounted to and support the second diverter 56, and form a base to support the end plate 52. The fins 64 shown in FIG. 2 extend downward through the second pipe 20 and are mounted at their lower ends 66 to an upper end of the first pipe 10. Alternatively, the lower ends 66 of the fins 64 could be mounted to a collar (not shown), which would in turn be mounted to the upper end of the first pipe 10.

Alternatively, the fins 64 may be configured as shorter, extending between the end plate 52 and the upper edge 24 of the second pipe 20. Brace members (not illustrated) could be provided to mount the first pipe 10 at the inlet of the second pipe 20.

Figure 3:
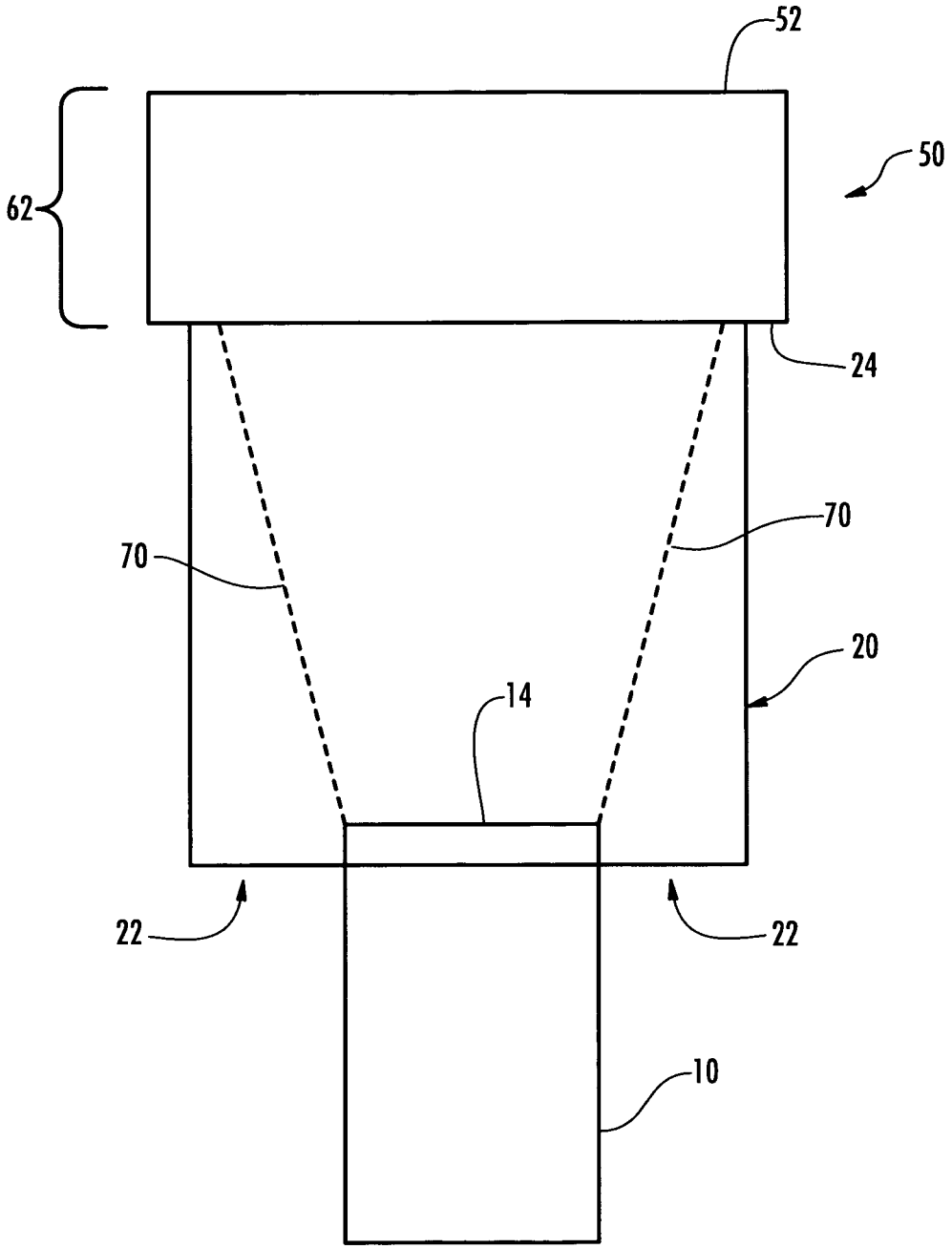

The flow characteristics of the diluter/diffuser of the invention will be described in connection with FIG. 3, which shows a schematic view of the device. FIG. 3 shows the first pipe 10, an outlet 14 of the first pipe, the second pipe 20 and the disperser 50.

As mentioned, the invention relies on two effects, diffusion of the hot exhaust gases and a buoyancy or stack effect to draw cooling ambient air into the diffuser 20. "Stack effect" is a buoyancy induced flow that is created by the difference in density between a higher temperature, lower density gas (in this case the exhaust gas) and a lower temperature, higher density gas (the ambient air).

The exhaust gas is allowed to expand in the second pipe 20 so as to reduce the heat flux of the gas. This spreads the thermal energy of the hot exhaust gas over a larger area (i.e., the outer surface areas of the diffuser), and decelerates the exhaust flow to a point were it can effectively mix with ambient air.

As is known, a higher temperature, lower density gas will form a plume as it rises through a lower temperature, higher density gas. In buoyant flow, the plume will expand at a constant 15°.

The broken lines 70 in FIG. 3 begin at the outer margin of the outlet 14 of the first pipe 10 and are oriented at 15° from the vertical to show the space a buoyant plume forming from hot exhaust gas exiting the first pipe 10 would occupy in the second pipe 20.

Two considerations in specifying the dimensions of the second pipe relative to the outlet of the first pipe are to avoid creating a Venturi-like throat at the ambient air inlet 22, and to have sufficient space in the second pipe to allow the exhaust gas exiting the first pipe to expand to create the buoyancy effect.

The second pipe 20 is configured to be a buoyancy mixing conduit by dimensioning the second pipe to avoid constraining the plume development, so that the cross-sectional area of the exhaust plume is at least as great as the cross-sectional area of the second pipe to induce the ambient air flow. This relationship is illustrated by the relative position of the broken lines 70 indicating a plume expansion and the outline of the second pipe in FIG. 3. Stated in terms of the diameters of the first pipe 10 and the width of the inlet gap 22, the diameter of the second pipe 20 is equal to or greater than the diameter of the outlet 14 of the first pipe 10 plus twice the inlet gap 22 width.

To avoid creating a Venturi-like throat at the second pipe inlet 22, the cross-sectional area of the second pipe inlet 22 is preferably established to be greater than or equal to the cross-sectional area of the outlet 14 of the first pipe (taking the total area surrounding the first pipe outlet 14). This means that the diameter of the second pipe 20 is at least twice the diameter of the first pipe 10.

Taking these relationships into account, the inventor determined that the second pipe 20 preferably has a height (measured between the inlet 22 and the upper edge 24) of at least 2.5 times the width of the inlet gap 22.

As an upper limit, a height of not more than 15 times the diameter of the second pipe 20 is preferable. Keeping the height at not more than 15 times the diameter of the second pipe 20 ensures the flow has sufficient energy to disperse radially outward from the second pipe outlet 62.

In addition, it was determined that the outlet 62 of the disperser 50 should allow for the flow of mixed gas without creating backpressure. The area of the outlet 62 is preferably greater than the area of the outlet 14 of the first pipe 10.

The invention has been described in terms of preferred embodiments and structure; however those skilled in the art will understand that substitutions and variations may be made without departing from the scope of the invention ad defined in the appended claims.

What is claimed is:

1. An apparatus for cooling exhaust gases from an engine exhaust, comprising:

a first pipe forming a vertically directed outlet for an exhaust conduit;

a second pipe mounted to receive an exhaust gas flow from the outlet of the first pipe, the second pipe having a diameter at least twice a diameter of the first pipe and positioned relative to the first pipe to define an ambient air annular inlet gap surrounding the outlet of the first pipe, the second pipe having a height that is at least 2.5 times a width of the inlet gap; and, a dispersing outlet mounted at an end of the second pipe and configured to direct exhaust gas radially outward, wherein the dispersing outlet comprises an end plate having a conical protrusion formed there on and directed into the exhaust flow, the plate being spaced from an end of the second pipe to define there between a radial outlet opening; and an unnular deflector plate mounted between the end of the second pipe and the end plate, the deflector plate having a downward facing frusto-conical protrusion wherein the annular defelctor plated has a centrally located hole sized to allow exhaust gas to pass there through.

2. The apparatus of claim 1, wherein the second pipe has a height that is not more than 15 times the width of the inlet gap.

3. The apparatus of claim 1, wherein an area defined by the inlet gap is at least equal to an area of the outlet of the first pipe.

4. The apparatus of claim 1, further comprising a plurality of vertically and radially disposed fins mounted to the second pipe and supporting the end plate and deflector plate.

5. The apparatus of claim 1, wherein an area defined by the dispersing outlet is greater than an area of the outlet of the first pipe.

6. The apparatus of claim 1, wherein the second pipe has an outwardly curving lip at an end leading to the dispersing outlet.

7. An apparatus for cooling exhaust gases from an engine exhaust, comprising:

a first pipe forming a vertically directed outlet for an exhaust conduit;

a second pipe mounted to receive an exhaust gas flow from the outlet of the first pipe, the second pipe having a diameter at least twice a diameter of the first pipe and positioned relative to the first pipe to define an ambient annular air inlet gap surrounding the outlet of the first pipe, an area defined by the inlet gap is at least equal to an area of the outlet of the first pipe, the second pipe having a height that is at least 2.5 times a width of the inlet gap;

a dispersing outlet mounted at an end of the second pipe and configured to direct exhaust gas radially outward, an area defined by the dispersing outlet being greater than an area of the outlet of the first pipe, the dispersing outlet comprising an end plate having a conical protrusion formed there on and directed into the exhaust flow, the plate being spaced from an end of the second pipe to define therebetween a radial outlet opening; and, an annular deflector plate mounted between the end of the second pipe and the end plate, the deflector plate having a frusto-conical cross section with a downward facing surface and a centrally located hole sized to allow exhaust gas to pass therethrough.

8. The apparatus of claim 1, wherein the second pipe defines between the first pipe outlet and the dispersing outlet an expansion space for exhaust gas exiting the first pipe to form a buoyant plume.

* * * * *